United States Patent [19]

Pierce et al.

[11] Patent Number: 4,487,345

[45] Date of Patent: Dec. 11, 1984

[54] BACKPACK CHAIR

[76] Inventors: Mel P. Pierce, 34511 Via Espinoza, Capistrano Beach, Calif. 92624; Kenneth O. Merrill, 329 Calle Dorado, San Clemente, Calif. 92672

[21] Appl. No.: 453,338

[22] Filed: Dec. 27, 1982

[51] Int. Cl.[3] ..... A45F 4/02

[52] U.S. Cl. ..... 224/155; 224/213; 297/191; 297/17

[58] Field of Search ..... 224/153, 154, 155, 156, 224/210, 213; 297/1, 2, 129, 191, 17, 22, 19, 16, 27

[56] References Cited

U.S. PATENT DOCUMENTS

| | | | |
|---|---|---|---|
| 1,615,159 | 1/1927 | Bonner | 224/155 |
| 2,201,964 | 5/1940 | Blank | 297/27 |
| 2,560,985 | 7/1951 | Rideout | 297/27 X |
| 2,843,185 | 7/1958 | Clem et al. | 224/155 X |
| 3,266,686 | 8/1966 | Griffith | 224/155 |
| 3,544,157 | 12/1970 | Muller | 297/17 X |
| 4,037,763 | 7/1977 | Turchen | 224/153 |
| 4,072,341 | 2/1978 | Kurz | 297/27 |
| 4,300,707 | 11/1981 | Kjaer | 224/155 |

FOREIGN PATENT DOCUMENTS

| | | | |
|---|---|---|---|
| 1222975 | 6/1960 | France | 297/1 |
| 1194851 | 6/1970 | United Kingdom | 224/155 |

*Primary Examiner*—Stephen Marcus
*Assistant Examiner*—Robert Petrik
*Attorney, Agent, or Firm*—Grover A. Frater

[57] ABSTRACT

A backpack is disclosed which is provided with shoulder straps and a back rest. The shoulder straps and back are independent of the pack container whereby to permit distribution of the weight to be carried and to facilitate the carrying of heavy loads. The frame is formed of a series of sub-frames which unfold to form a structure which can serve as a chair and as a stand for holding and retaining the pack container in upright position when the pack is not being carried.

5 Claims, 8 Drawing Figures

BACKPACK CHAIR

TECHNICAL FIELD

This invention relates to improvements in backpacks, and it relates in particular to a backpack whose frame forms a chair when unfolded.

BACKGROUND ART

Most backpacks have no frame. They consist of little more than a container of pliant material to which shoulder straps are affixed. Day packs, knapsacks, book bags, bike bags, and the like, are examples.

Backpacks intended for carrying specifically identified loads often have frames shaped to accommodate that load. One of the most common is a backpack for carrying children. In that example, the frame and the pack, the container, form a sling or seat in which the child is seated while being carried.

On the other hand, general purpose packbacks which are to be capable for use in carrying heavy, bulky loads have a frame shaped to permit distribution of the load. Such frames usually comprise side bars interconnected at their upper and lower ends by cross-members to form a generally rectangular structure. The pack is made of pliant material and is suspended from the upper cross-member or the side bars or both cross-member and side bars.

An important feature of such a structure is that the element that rests against the wearer's back is separated physically from the walls of the pack container. The contents of the pack container are likely to cause depressions and bulges and protrusions in its forward side that would cause considerable discomfort if permitted to engage the pack carrier's back. Instead, a back rest is stretched taut across the side rails of the backpack frame in a region of the frame at which it, rather than the pack container, will rest upon the wearer's back. The shoulder straps of the conventional, framed backpack extend from an upper crossbar to respectively associated points on the side bars of the frame.

The result of the assemblage of back rest, shoulder straps, frame and pack container is an apparatus which is efficient for the performance of its primary task. A conditioned wearer can use it to carry heavy loads for long periods over difficult terrain. However, once removed from the wearer's back, it is awkward, will not readily stand with the pack container upright, and is thoroughly inconvenient.

DISCLOSURE OF INVENTION

An object of the invention is to provide a backpack which has most of the advantages of the conventional framed backpack unit and few of its undesirable qualities.

It is an object to provide an efficient, easily carried backpack unit which serves multiple utilitarian purposes other than for carrying loads on one's back. One of those purposes is to provide a frame which serves the same function when the load is being carried as does a conventional frame but whose elements can be rearranged to form a stand which will hold the pack container upright and above and away from the ground when the backback is removed and set down.

A further object is to provide a frame which, when not being carried, forms a stand for the pack container by being unfolded and without need to reassemble the frame. Furthermore, in the preferred form of the invention the frame unfolds to form, alternatively, a chair in which one may sit or a platform for a variety of purposes.

It is common, when going on an outing, to find it necessary to carry food and play apparatus, towels and other articles for substantial. distances. The distance from automobile parking area to beach or some picnic place may be great enough to warrant use of a backpack. Conventional framed backpacks are well suited to that task but they are not particularly useful, and may be less than useful at their destination.

The invention overcomes that lack of utility with little or no loss of the advantage of conventional backpack frames. In preferred form, the pack frame includes two rectangular frames each formed by a pair of side members and a pair of cross-members. One of the pair serves as the frame for a chair back and the other as a frame for a seat, and each frame carries a panel whereby the back frame and its panel form a back and the seat frame and its panel form a seat.

The back and seat are pivotally interconnected whereby they can be folded to be substantially parallel or pivoted such that one lies in a plane that is ninety degrees or more from the other. In preferred form, the two frames share a common cross rail about which the back and seat pivot relative to one another.

The panel that forms the chair back can, and in preferred form does, form the forward side of the pack container.

The forward or underside of the seat panel can serve as the back panel, the panel that rests against the wearer's back when the seat and chair back are folded together to form the backpack frame. However, in the preferred form. the back rest panel is formed by a third panel member which is carried by a pair of forwardly extending legs. The legs are pivotally connected to the side rails of the seat frame. The back rest panel is connected, in preferred form, between the forward or upper cross rail of the seat frame and a rail that connects the forward ends of the two forward legs.

The latter rail is padded and normally fits in the small of the wearer's back when the frame is folded and serves as a backpack frame.

The back rest panel is arranged to be stretched taut when the frame is folded. In that condition, it can support the upper end of the shoulder straps. The straps may be connected to the forward or upper cross bar of the seat panel, but tautness of the back panel is better insured when the straps are affixed to the back panel in the vicinity of the cross bar.

One of the advantages of the frame in this form is that rear legs and even arm rests may be added. The preferred form employs those elements to give the chair a conventional form and appearance, and to elevate the pack container in the unfolded condition of the frame.

DESCRIPTION OF PREFERRED EMBODIMENT

Figure 1:
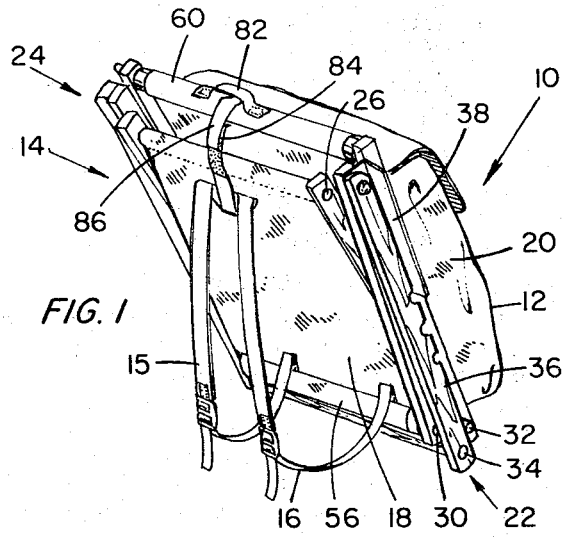
FIG. 1 is an isometric view of a preferred form of backpack according to the invention.

The assembled backpack is shown in FIG. 1 where the unit is designated 10. It comprises a pack container 12 which is formed of a pliant material, a frame generally designated 14, a pair of shoulder straps 15 and 16, and a back rest 18 which bears upon the back of a person carrying the unit with the shoulder straps extending over the shoulders.

The frame is formed by a number of members which extend substantially parallel with the side edges of the back rest member 18 and with the side panels of the pack container. One of those side panels is visible in FIG. 1 where it is numbered 20. There are two sets of those side members. The set at the right side of the figure, which would be at the left side of the wearer of the pack, is numbered 22. The set on the opposite side, which would be at the wearer's right side, is generally numbered 24. The several members of each set of side members have pivotal connection one to the other, and the two sets of side members are interconnected by four cross bars, or cross rails. Two of those cross bars are disposed at the upper end of the unit, and two of them are disposed at the lower end of the unit. The cross members are disposed within portions of a pliant covering member, but their ends are visible in FIG. 1. The ends of the two upper members are numbered 26 and 28, respectively. The ends of the two lower cross bars are numbered 30 and 32, respectively.

The frame of FIG. 1 includes a rear leg and an are rest in each of the side member sets 22 and 24, and it includes a cross bar which interconnects the lower end of the two rear legs. The end of that cross bar is visible in FIG. 1 where it is numbered 34. The rear leg and the arm rest of the side member set 22 are numbered 36 and 38, respectively.

Figure 2:
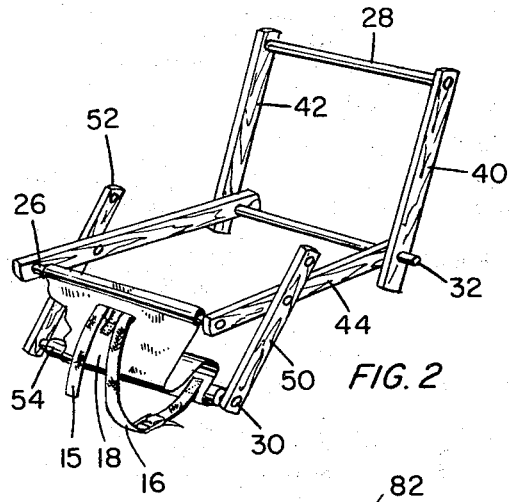
FIG. 2 is an isometric drawing of a portion of the frame of FIG. 1 shown in dissembled condition and incorporating a fragment of the back rest and arm strap structures.
Figure 3:
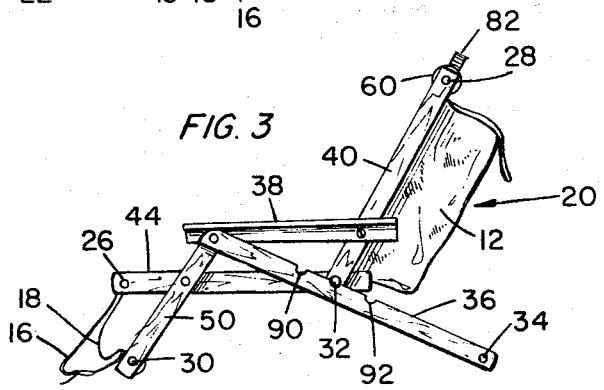
FIG. 3 is a view in side elevation of the backpack of FIG. 1 with its frame dissembled to form a chair.

The rear legs and the cross bar 34, and the arm rests, while important, are important primarily when the frame is unfolded into its chair form. The remaining portions of the frame are important both when the frame is folded to form a backpack frame and when unfolded to form a stand for the pack container and to form a chair. Those remaining elements are shown in their unfolded, chair, condition in FIG. 2. The cross members 28 and 32 interconnect side members 40 and 42, respectively. Taken together, the cross members 28 and 32, and side members 40 and 42, form a generally rectangular frame which serves both as the frame for the pack container and as the frame for the back of the chair structure when the frame is unfolded. The cross members 32 and 26 interconnect side members 44 and 46. Taken together, the cross members 26 and 32, and the side members 44 and 46, form a frame for what is the seat portion of the unit when the frame is unfolded. The frame for the chair back and the frame for the chair seat are pivotally interconnected so that the frames may be folded into a position in which they are substantially parallel one to the other as they are shown to be in FIG. 1, or so that they can be folded out to approximately perpendicular condition or more as shown in FIGS. 2 and 3. In the preferred form, the cross member 32 forms a cross member for both of those frame units, and it forms the member on which the two frame sections pivot relative to one another.

Two of the side members of the frame serve as front legs when the frame is unfolded into chair and support form. Those legs are shown in FIG. 2 to have the position they occupy in the unfolded condition. The leg at the left side of the chair, the right side of FIG. 2, is numbered 50. The other leg at the other side of the frame is numbered 52. Leg 50 is mounted pivotally on the chair seat frame side member 44, and the leg 52 is pivotally mounted on the chair seat frame side member 46. Those legs are interconnected at their lower end by the cross member 30.

The back rest 18 is formed by a pliant member which is connected at its upper end to cross member 26 of the seat frame, and at its lower end to the cross member 30 of the forward legs. That back rest 18, which is held taut when the frame is folded as it is shown to be in FIG. 1, is loose and easily pushed out of the way under the seat when the frame is unfolded. The shoulder strap members 15 and 16 are adjustable in length. They are connected at their upper ends to the upper end of the back rest 18, and they are connected at their lower ends to the lower end of the back rest 18. They could be connected to the cross bar 26 at the upper end and to the legs 50 and 52, or to the cross member 30, at their lower ends; however, in the preferred form, the ends of the shoulder straps are connected to the back rest 18. That arrangement helps to insure that the back rest 18 remains taut and operates as a unit with the shoulder straps in permitting the wearer to make adjustments to alter the position of the center of gravity of the backpack in a greater degree than would otherwise be true.

In this preferred embodiment, the cross member 30 extends through a hollow cylindrical member 54 which is resilient and serves as a padding. The lower end of the back rest member 18 is wrapped around that padding member 54. The effect is to produce a resilient roll which is numbered 56. The shoulder straps can be adjusted so that that padded cross member fits within the small of the back of a backpack wearer and serves as an additional means for distributing the weight of the pack over several portions of the wearer's body.

As shown in FIGS. 1, 3, 4 and 5, the cross bar 28 at the upper end of the seat back portion of the frame is fitted with a similar resilient cylindrical cushion roll to form a cushion at the upper edge of the chair back portion of the frame in the unfolded condition. That cushion portion is numbered 60 in the several figures.

Figure 4:
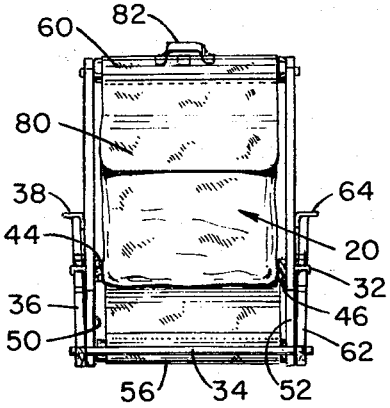
FIG. 4 is an elevational view showing the unit of FIG. 3 as it appears from the rear.
Figure 5:
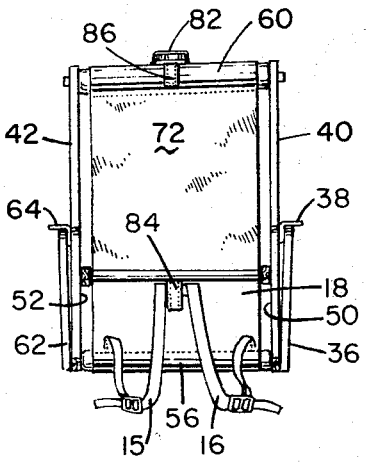
FIG. 5 is an elevational view showing the unit of FIG. 3 as it appears from the front.

The rear leg 62 and the arm rest 64 at the right side of the chair are visible in FIGS. 4 and 5.

Figure 6:
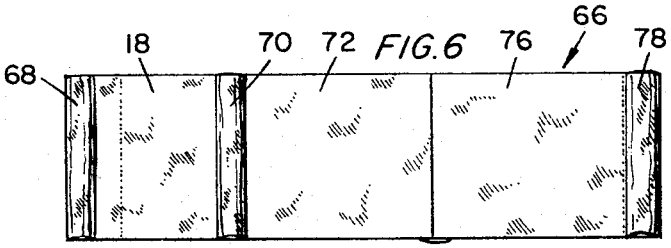
FIG. 6 is a top plan view of the pliant portions of the structure that form the back rest and seat and forward portion of the pack container.
Figure 7:
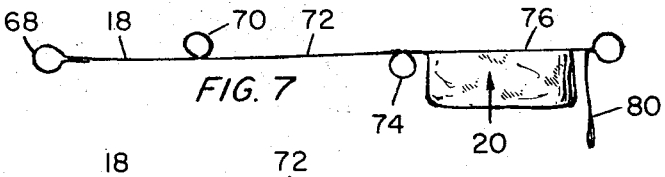
FIG. 7 is a side view of the pliant element shown in FIG. 6.
Figure 8:
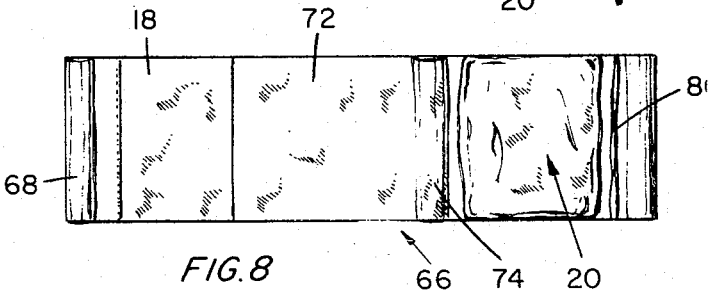
FIG. 8 is a bottom plan view of the structure of FIGS. 6 and 7.

In this preferred embodiment, the seat is a panel of fabric mounted in the seat portion of the frame, the chair back is a panel of fabric which is mounted in the chair back portion of the frame and serves also as the forward wall of the pack container. The back rest 18 is also formed of a fabric panel and, in the preferred embodiment, those several panels and the cover flap of the pack container are formed of a single length of fabric as best shown in FIGS. 6, 7 and 8. The length of fabric is generally designated 66. In those FIGS. 6, 7 and 8, the panel which serves as the back rest is numbered 18. That portion of the length of fabric which encompasses the cushion roll 54 is designated 68. The fabric is sewn to form an elongated loop 70 through which the cross member 26 extends. The seat panel is formed by that portion of the length of fabric which is designated 72 in FIGS. 6, 7 and 8. An elongated loop is sewn transversely across the length of fabric to form a loop 74 through which the pivot cross member 32 extends. The panel 76 is the one that forms the back of the chair structure and, as best shown in FIG. 7, also forms the forward wall of the pack container 20. Toward its rightmost end in FIGS. 6, 7 and 8, the length of fabric is formed into another elongated transverse loop 78 which, in the assembled backpack, contains the cross member 28 and the cushioning cylinder which surrounds it. Not visible in FIG. 6, but shown in FIGS. 7 and 8, is the end extension of the length of pliant member which serves as the cover flap for the backpack container. That cover is designated 80 in the several figures of the drawing.

To facilitate carrying of the backpack under some circumstances, a hand hold loop 82 is sewn to the length of covering fabric at the upper side of the cushion roll 60. Finally, a means is provided for retaining the frame in its folded, or collapsed, condition as shown in FIG. 1. That means is formed by two lengths of materials, one sewn to the upper end of the back panel 18, and the other sewn to the cushion roll 60 just below the carrying handle 82. The first of those lengths of material is numbered 84, and the other is numbered 86 in the drawing. In this preferred form, one of those materials is provided with a plurality of hooks and the other a fabric which is readily engaged by those hooks.

One of the advantages of mounting the back rest panel 18 between a portion of the chair seat and the end of the lower legs is that the panel is taut only when the frame is folded to its backpack position. When the frame is unfolded, the panel 18 is loosed so that the legs may be adjusted to adjust the relative angular position of the seat and the back of the chair structure. As a part of that adjustability, the upper edge of the two rear legs are formed with notches to receive the outwardly projecting ends of the cross member 32. The two rear legs are notched in similar fashion, although only one of them is visible in the drawings. In FIG. 3, the cross member 32 is shown lodged in the middle of a set of three notches the upper and lower ones of which are numbered 90 and 92, respectively.

The rear legs 36 and 62 are made sufficiently long so that the cross member 34 is below cross members 30 and 32 when the frame is in the assembled condition shown in FIG. 1. That arrangement permits the legs to swing out of the way.

Although I have shown and described certain specific embodiments of our invention, I am fully aware that many modifications thereof are possible. Our invention, therefore, is not to be restricted except insofar as is necessitated by the prior art.

We claim:

1. A backpack unit comprising:

a pack container having a forward wall panel;

a pair of shoulder straps;

a back rest panel adapted to rest against the back of a wearer of said shoulder straps;

a frame in the form of a folding chair frame including a back panel frame and a seat panel frame and a pair of front legs pivotally mounted on the seat panel frame and capable of being folded such that the back panel frame and the seat panel frame and the front legs fold substantially parallel and adjacent to one another;

said forward wall panel of the pack container being attached to said back panel frame;

said back rest panel extending between connections to said forward legs and said seat panel frame; and further comprising a cross member interconnecting said legs in the region of their lower ends and said connections of the back rest panel to said forward legs being made to said cross member.

2. The invention defined in claim 1 in which said back panel frame includes side members, an upper cross member and a lower cross member, the lower cross member forming part of said seat panel frame.

3. The invention defined in claim 2 in which each of said front legs has pivotal connection at a point intermediate their length to respectively associated sides of said seat frame; and which further comprises a pair of rear legs each leg of the pair having pivotal connection to the upper end of a respectively associated one of said front legs, whereby said seat frame may be pivoted relative to said front legs and said rear legs; and means fixed to at least one of said back frame and seat frame for engaging said rear legs and limiting the degree in which said seat frame may be pivoted relative to said rear legs.

4. The invention defined in claim 3 in which said last mentioned means comprises the cross member common to said back frame and said seat frame; and which further comprises a pair of arm rests each having pivotal connection to the upper end of a respectively associated one of said front legs and each having pivotal connection to a respectively associated side of said back rest frame whereby the angle between the back rest frame and seat rest frame is altered and the elevation of the seat frame is changed as an incident to increase in the angular separation of the front and rear legs.

5. A pack unit comprising:

a folding chair including a chair back, the back comprising a pair of spaced and parallel side rails;

a chair seat pivotally interconnected to said pair of rails of the back and capable of being pivoted to a position substantially parallel with said pair of side rails of the back;

a pair of front legs pivotally connected at a point intermediate the length of the legs to respectively associated sides of said seat and capable of being pivoted to a position substantially parallel with said back and said seat;

a pair of arm rests, each arm rest having pivotal connection to the upper ends of respectively associated ones of said front legs and to said back such that the arm rests are pivoted to a position substantially parallel to said back and said seat as an incident to pivoting of said front legs to a position substantially parallel with said seat and said back;

a pack container having the seat back as its forward wall; and said folding chair further comprising a pair of rear legs each rear leg of the pair having pivotal connection to said upper end of a respectively associated one of said front legs; and said pack unit further comprising a pliant back rest panel having connection at its upper end to said seat and at its lower end to the lower end of said front legs.

* * * * *